US010641537B2

(12) United States Patent
Mitchell et al.

(10) Patent No.: US 10,641,537 B2
(45) Date of Patent: May 5, 2020

(54) ICE MAKING SYSTEM FOR REFRIGERATOR APPLIANCE

(71) Applicant: Haier US Appliance Solutions, Inc., Wilmington, DE (US)

(72) Inventors: Alan Joseph Mitchell, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 302 days.

(21) Appl. No.: 15/347,854

(22) Filed: Nov. 10, 2016

(65) Prior Publication Data

US 2018/0128534 A1 May 10, 2018

(51) Int. Cl.

| | |
|---|---|
| ***F25D 17/06*** | (2006.01) |
| ***F25C 1/24*** | (2018.01) |
| *F25C 5/20* | (2018.01) |
| *F25C 1/22* | (2018.01) |
| *F25C 1/04* | (2018.01) |

(52) U.S. Cl.

CPC ..... *F25D 17/065* (2013.01); *F25C 1/24* (2013.01); *F25C 1/04* (2013.01); *F25C 1/22* (2013.01); *F25C 5/22* (2018.01); *F25D 17/062* (2013.01); *F25D 2317/061* (2013.01); *F25D 2317/062* (2013.01)

(58) Field of Classification Search

CPC ..... F25C 5/22; F25C 1/04; F25C 1/22; F25C 1/24; F25D 17/065; F25D 17/062; F25D 2317/062; F25D 17/061

See application file for complete search history.

(56) References Cited

U.S. PATENT DOCUMENTS

| | | | | |
|---|---|---|---|---|
| 7,392,665 | B2 | 7/2008 | Lee et al. | |
| 8,794,014 | B2 | 8/2014 | Kulkarni et al. | |
| 9,175,893 | B2 | 11/2015 | Junge et al. | |
| 9,200,828 | B2 | 12/2015 | Mitchell et al. | |
| 9,303,913 | B2 | 4/2016 | Ha | |
| 2011/0146331 | A1* | 6/2011 | Moon | F25C 1/04 62/407 |
| 2014/0150487 | A1 | 6/2014 | Boarman | |

* cited by examiner

*Primary Examiner* — David J Teitelbaum
(74) *Attorney, Agent, or Firm* — Dority & Manning, P.A.

(57) ABSTRACT

A refrigerator appliance includes a cabinet defining a fresh food chamber and a freezer chamber below the fresh food chamber. The refrigerator appliance further includes an ice maker disposed within the cabinet outside of the freezer chamber and proximate to the fresh food chamber. The ice maker includes an ice making chamber. The ice maker is in thermal communication with the freezer chamber and the ice making chamber is not in fluid communication with the freezer chamber.

14 Claims, 6 Drawing Sheets

ICE MAKING SYSTEM FOR REFRIGERATOR APPLIANCE

FIELD OF THE INVENTION

The present subject matter relates generally to refrigeration appliances, and more particularly to refrigeration appliances including features for making ice.

BACKGROUND OF THE INVENTION

Generally, refrigerator appliances include a cabinet that defines a fresh food chamber for receipt of food items for storage. Many refrigerator appliances further include a freezer chamber for receipt of food items for freezing and storage. Certain refrigerator appliances include an ice maker. In order to produce ice, liquid water is directed to the ice maker and frozen. Accordingly, refrigerator appliances having both an ice maker and a freezer chamber commonly include the ice maker in the freezer chamber since both operate at or around the same general temperatures. However, in many currently utilized refrigerator appliances, the freezer chamber is positioned below the fresh food chamber, which is sometimes referred to as a bottom freezer. In such refrigerator appliances, locating the ice maker in the bottom freezer may be inconvenient or otherwise not desired.

Accordingly, an ice making system for a refrigerator appliance with features permitting operation remote from the freezer chamber would be useful.

BRIEF DESCRIPTION OF THE INVENTION

A refrigerator appliance includes a cabinet defining a fresh food chamber and a freezer chamber below the fresh food chamber. The refrigerator appliance further includes an ice maker disposed within the cabinet outside of the freezer chamber and proximate to the fresh food chamber. The ice maker includes an ice making chamber. The ice maker is in thermal communication with the freezer chamber and the ice making chamber is not in fluid communication with the freezer chamber. Additional aspects and advantages of the invention will be set forth in part in the following description, or may be apparent from the description, or may be learned through practice of the invention.

In accordance with one embodiment, a refrigerator appliance is disclosed. The refrigerator appliance includes a cabinet defining a fresh food chamber and a freezer chamber, the freezer chamber positioned below the fresh food chamber along a vertical direction, the cabinet also includes an an icebox compartment outside of the freezer chamber and proximate to the fresh food chamber. The cabinet further includes a heat exchange opening at the icebox compartment. The refrigerator appliance also includes an ice maker disposed within the icebox compartment, the ice maker including a heat exchanger positioned at the heat exchange opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
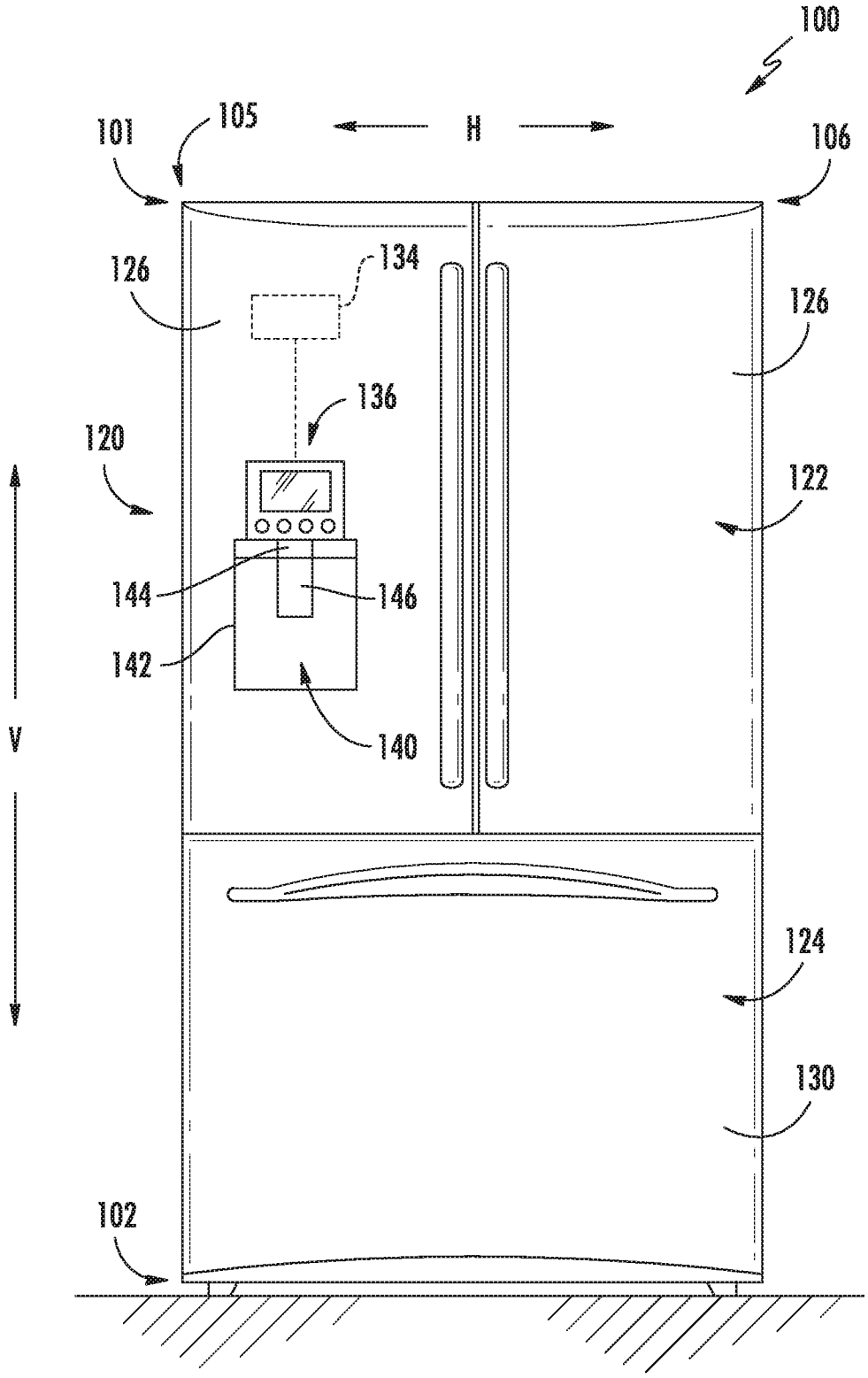
FIG. 1 provides a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of an exemplary embodiment of a refrigerator appliance 100. Refrigerator appliance 100 extends between a top portion 101 and a bottom portion 102 along a vertical direction V. Refrigerator appliance 100 also extends between a first side portion 105 and a second side portion 106 along a horizontal direction H. A transverse direction T (FIG. 2) may additionally be defined perpendicular to the vertical and horizontal directions V, H.

Refrigerator appliance 100 includes a cabinet or housing 120 defining an upper fresh food chamber 122 and a lower freezer chamber 124 arranged below the fresh food chamber 122 on the vertical direction V. As such, refrigerator appliance 100 is generally referred to as a "bottom mount refrigerator." In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or any other types of appliance as well. Consequently, the description set forth herein is for illustrative purposes only and is not intended to limit the invention in any aspect.

Refrigerator doors 126 are rotatably hinged to an edge of housing 120 for accessing fresh food chamber 122. It should be noted that while two doors 126 in a "French door" configuration are illustrated, any suitable arrangement of doors utilizing one, two or more doors is within the scope and spirit of the present disclosure. A freezer door 130 is arranged below refrigerator doors 126 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections, etc. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within the door 126. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

Figure 2:
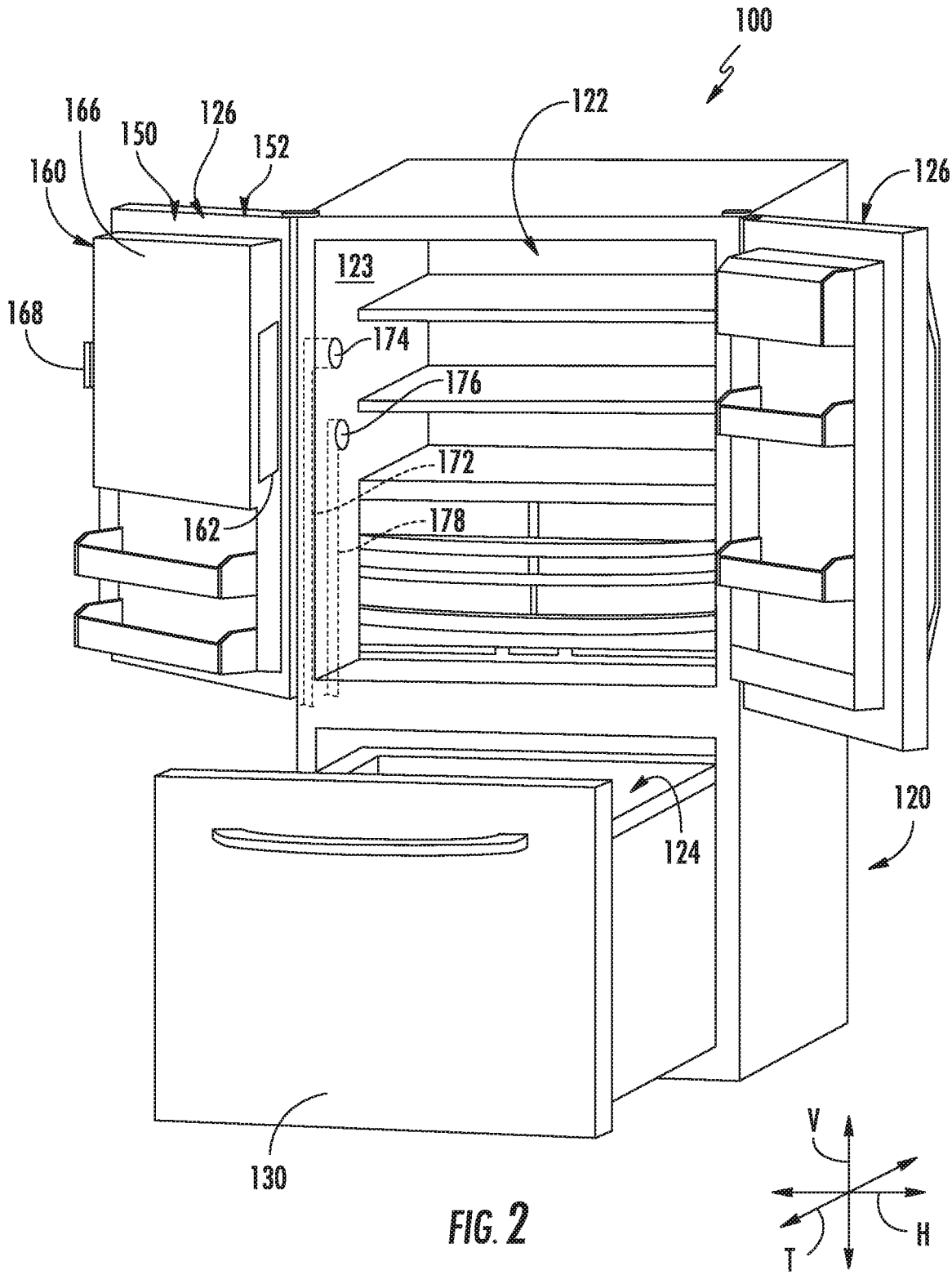
FIG. 2 provides a front perspective view of the exemplary refrigerator appliance of FIG. 1 with refrigerator doors of the refrigerator appliance shown in an open configuration to reveal a fresh food chamber and freezer chamber of the refrigerator appliance.

FIG. 2 is a perspective view of refrigerator appliance 100 having refrigerator doors 126 in an open position to reveal the interior of the fresh food chamber 122. Additionally, freezer door 130 is shown in an open position to reveal the interior of the freezer chamber 124.

Figure 3:
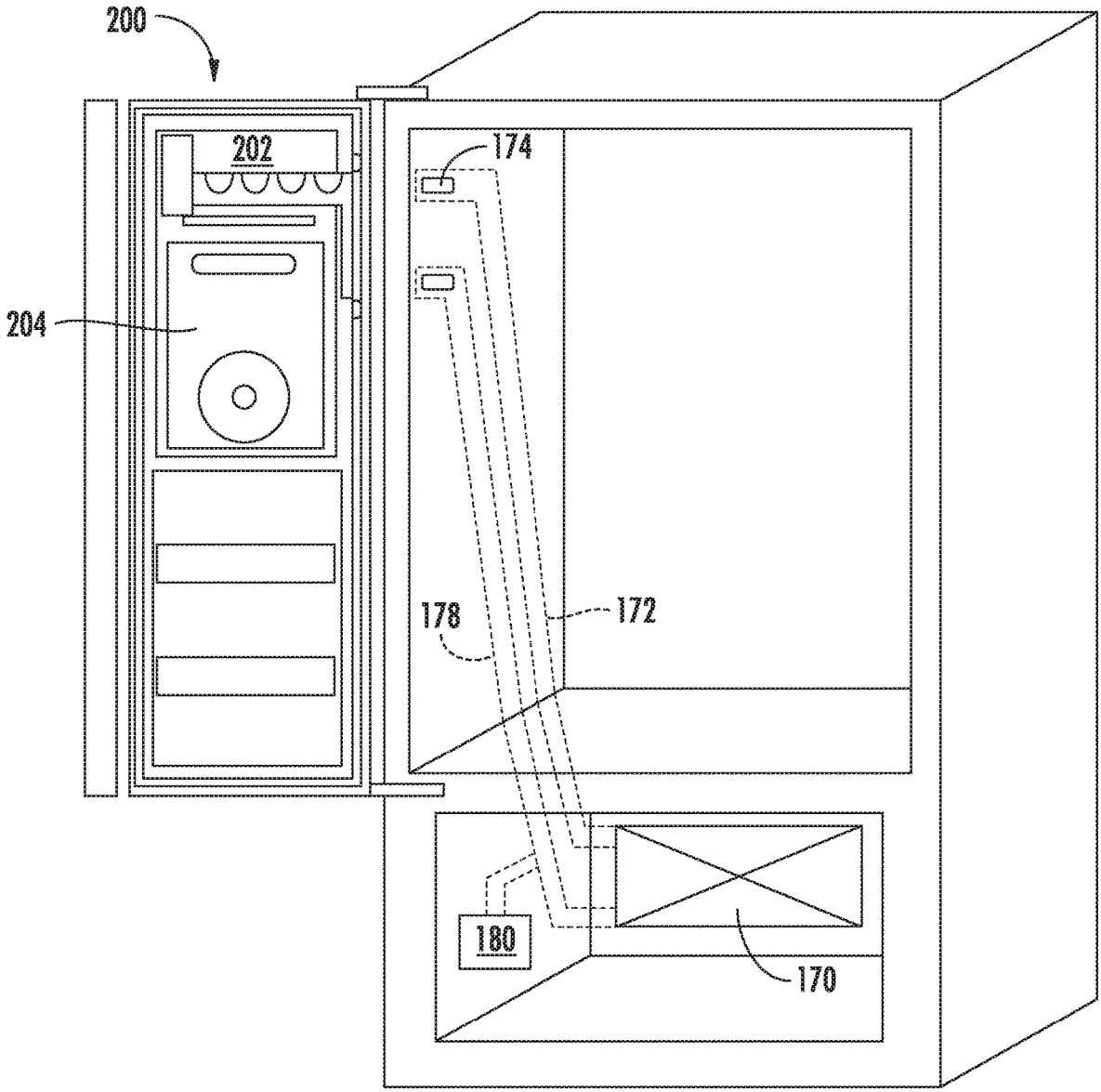
FIG. 3 provides a partial schematic view of an ice making system in a refrigerator door of the exemplary refrigerator appliance of FIG. 1 according to an exemplary embodiment of the present subject matter.

Referring now to FIGS. 2 and 3, a door 126 of the refrigerator appliance 100 may include an inner surface 150 and an outer surface 152. The inner surface 150 generally defines the interior of the fresh food chamber 122 when the door 126 is in a closed position as shown in FIG. 1, while the outer surface 152 is generally opposite the inner surface 150 and defines the exterior of the refrigerator appliance 100.

As shown for example in FIG. 3, an ice making system 200 may be provided outside of the freezer chamber 124 and proximate to the fresh food chamber 122, e.g., in one of the doors 126, such as disposed in a compartment 160, which may be referred to as an icebox compartment 160, defined at the inner surface 150 of one of the doors 126. In such embodiments, the ice making system 200 may be disposed at least partially within the fresh food chamber 122 when the door 126 is in the closed position. Ice making system 200 may include an ice making chamber 202 where ice may be formed in a mold body 210. Ice making system 200 may also include an ice storage bin 204 disposed in communication with the mold body 210, e.g., below mold body 210, for receipt and storage of ice once the ice has been formed in mold body 210.

The ice making system 200 may, as discussed herein, be in thermal communication with freezer chamber 124. In some exemplary embodiments, the ice making chamber 202 may not be in fluid communication with the freezer chamber 124. In other words, in such embodiments, the ice making chamber 202 may be isolated from the freezer chamber. For example, in such embodiments, thermal communication between ice making system 200 and freezer evaporator 170 may be by convection, i.e., air flow, from evaporator 170 to a heat exchanger 206 and by conduction from heat exchanger 206 to the mold body 210 in the ice making chamber 202. Providing cold air from the evaporator 170 to heat exchanger 206 rather than into ice making chamber 202 may permit more efficient thermal energy transfer from the cold air to the ice maker mold body 210. That is, rather than circulating cold air above the mold body 210, impinging a flow of cold air on the heat exchanger 206 which is in direct conductive thermal communication with the mold body 210 allows the cold air to more directly influence the mold body 210. As a result, the ice making system 200 may be more efficient and provide faster ice production.

In general, the ice making system 200 and various components thereof, may be provided with insulation 164 (FIG. 4) to reduce heat exchange between the ice making system 200 and the fresh food chamber 122 as well as between ice making system 200 and the ambient environment, e.g., such that the temperature within ice making chamber 202 and ice storage bin 204 can be maintained at levels different from, e.g., cooler than, the temperature in the fresh food chamber 122. The ice compartment 160 may include a heat exchange opening 162. The ice maker compartment 160 may be otherwise completely enclosed by insulation 164, except at the heat exchange opening 162. In exemplary embodiments, various features for providing access to ice stored in the ice storage bin may be provided. In one example, an insulated door may be provided in the compartment 160 for access to the ice storage bin. In other embodiments, the outer surface of door 126 may include a dispenser feature, as is generally understood by those skilled in the art, which extends through the insulation 164 on the opposite side of compartment 160 from the fresh food chamber 122 when door 126 is in the closed position.

Turning back to FIG. 1, in some exemplary embodiments, ice from storage bin 204 may be supplied to dispenser recess 140 on the outer surface 152 of refrigerator door 126. In such embodiments, refrigerator appliance 100 may include a dispenser assembly, e.g., for delivering or dispensing ice. Dispenser assembly may include a dispenser 142 positioned on or mounted to an exterior portion of refrigerator appliance 100, e.g., on one of refrigerator doors 126. Dispenser 142 may include a discharging outlet 144 for accessing ice. An actuating mechanism 146, shown as a paddle, may be mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. Discharging outlet 144 and actuating mechanism 146 may be external parts of dispenser 142 which may be mounted in a dispenser recess 140. Dispenser recess 140 may be positioned at a predetermined elevation convenient for a user to access ice or water and enabling the user to access ice without the need to bend-over and without the need to open refrigerator doors 126. In some exemplary embodiments, dispenser recess 140 may be positioned at a level that approximates the chest level of a user.

In some exemplary embodiments, an access door—e.g., icebox door 166 (FIG. 2)—may be hinged to icebox compartment 160 to selectively cover or permit access to opening of icebox compartment 160. In such embodiments, icebox door 166 permits selective access to icebox compartment 160. Any manner of suitable latch 168 may be provided with icebox compartment 160 to maintain icebox door 166 in a closed position. In some exemplary embodiments, latch 168 may be actuated by a consumer in order to open icebox door 166 for providing access into icebox compartment 160. In exemplary embodiments which include icebox door 166, insulation 164 is provided throughout icebox door 166 for thermally isolating or insulating icebox compartment 160 from fresh food chamber 122.

Figure 5:
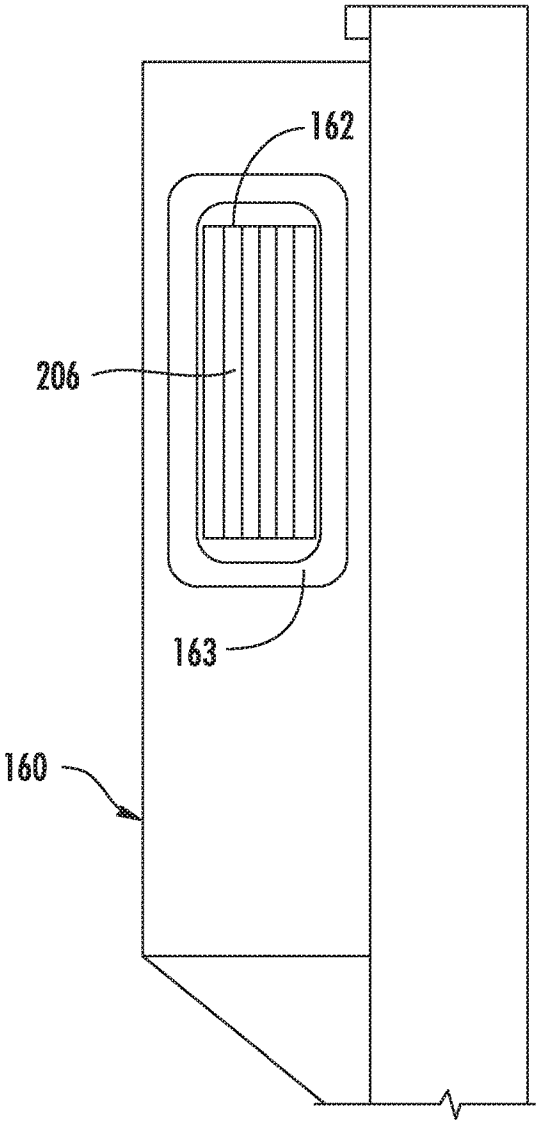
FIG. 5 provides a partial side view of the ice making system and the refrigerator door of FIG. 3.
Figure 4:
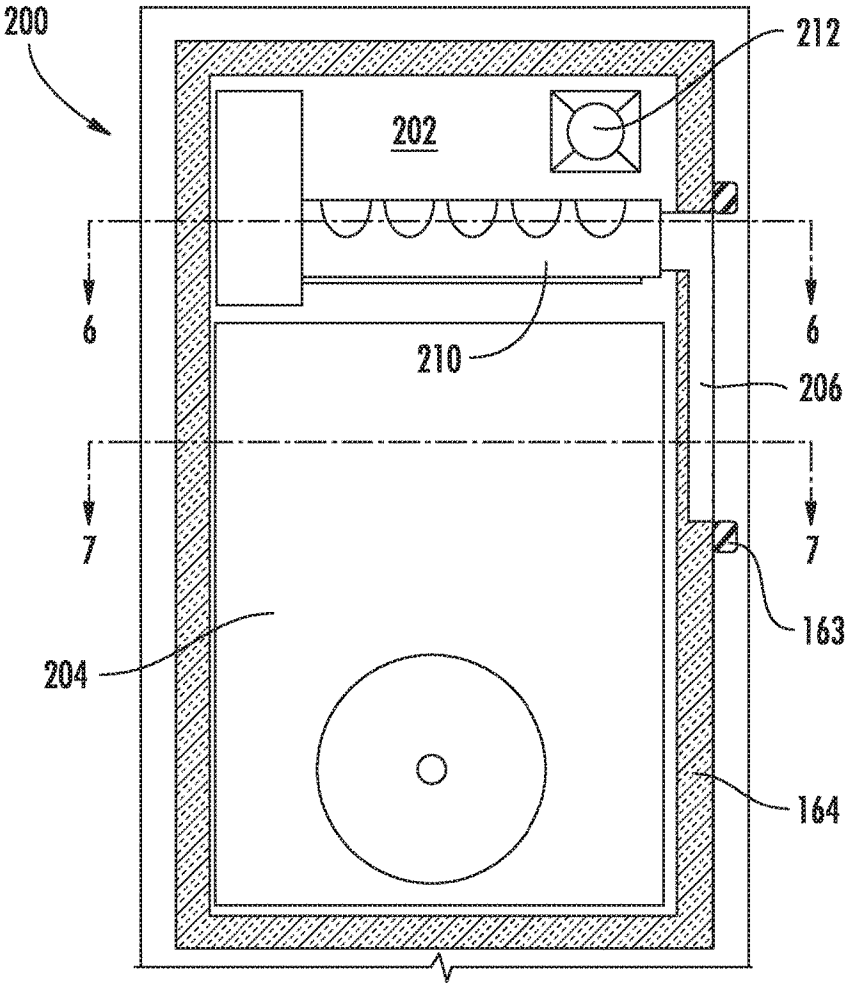
FIG. 4 provides a partial section view of the ice making system of FIG. 3.

In some embodiments, for example as illustrated in FIGS. 4 and 5, a gasket 163 may be provided at an outer surface of the icebox compartment 160. The gasket 163 may enclose heat exchange opening 162. When the door 126 is in a closed position, gasket 163 may sealingly engage a side wall 123 of the fresh food chamber 122 to prevent air leakage when the door 126 is in a closed position. For example, gasket 163 may help to prevent or minimize cold air flowing between supply duct 172 and return duct 178 from escaping into the fresh food chamber 122 and/or relatively warm, humid air from fresh food chamber 122 from entering return duct 178 or contacting heat exchanger 206. In alternative embodiments, gasket 163 may be positioned on side wall 123 of the fresh food chamber 122 and extend between side wall 123 and the outer surface of the icebox compartment 160 at heat exchange opening 162 when door 126 is in the closed position.

Although the gasket 163 prevents or minimizes relatively warmer and more humid air from fresh food chamber 122 or the ambient environment from contacting the heat exchanger 206 when the door 126 is in the closed position, when the door 126 is opened, condensation may gather on heat exchanger 206 which may lead to frost formation on heat exchanger 206. In such cases, because the cold air from the evaporator 170 tends to be relatively dry (i.e., low humidity), it may provide sublimation defrosting of the heat exchanger 206. That is, because the humidity of the air from the evaporator 170 is so low, some or all frost which may form on the heat exchanger 206 may evaporate when exposed to air from evaporator 170 passing over it. As such, any water which collects on the heat exchanger 206 in the form of condensation will travel at least partly as water vapor through ducts 172 and 178 rather than as liquid water, i.e., liquid water in ducts 172 and 178 is avoided or minimized.

Various components may be utilized to facilitate the temperature variance between ice making system 200 and fresh food chamber 122. For example, in one embodiment, ice making system 200 may be in fluid communication with the freezer chamber 124. As shown, e.g., in FIGS. 2 and 3, in some embodiments, the ice making system 200 may be in fluid communication with an evaporator 170 which may be disposed in or near the freezer chamber 124. In some embodiments, supply duct 172 and return duct 178 may extend between and provide the thermal communication between the ice making system 200 and freezer chamber 124. Such communication between evaporator 170 and ice making system 200 may be provided or enhanced by various air movers, such as a blower or fan 180, connected to one or the other of supply duct 172 and return duct 178. Supply duct 172 may include, for example, supply outlet 174 supplying cold air from freezer chamber 124 to an exterior portion of ice making system 200. Return duct 178 may include, for example, return inlet 176 flowing air from ice making system 200 to freezer chamber 124. Ducts 172 and 178 may generally be disposed within the refrigerator appliance 100, such as within the various walls defining the chambers 122, 124. In some exemplary embodiments, the ducts 172 and 178 may be foamed in place within the various walls of the refrigerator appliance 100.

The ice making system 200 may be in convective thermal communication with the freezer chamber 124. In some embodiments, such convective thermal communication may be provided by the circulation system 170 which circulates cold air from the freezer chamber 124 to the ice making system 200 and in particular to a heat exchanger 206 thereof. In some embodiments, the heat exchanger 206 does not include or employ liquid refrigerant, the circulation of cold air alone cools the heat exchanger 206.

In some exemplary embodiments, the ice maker 200 may include a mold body 210 configured for receiving liquid water and forming ice in the mold body 210. The mold body 210 may be so configured by forming the mold body 210 with a series of impressions or recesses which receive liquid water therein and hold the liquid water at least until the liquid water freezes. In some exemplary embodiments, the ice maker 200 may include features for harvesting the ice from the mold body 210 once it has been formed, as well as features for storing and/or dispensing the harvested ice. In some exemplary embodiments, the mold body 210 may be in conductive thermal communication with the heat exchanger 206 to cool the mold body 210 and permit ice formation therein. Such conductive thermal communication may be provided in some exemplary embodiments by direct contact between the heat exchanger 206 and mold body 210. In some exemplary embodiments, mold body 210 and heat exchanger 206 are formed of a material with a high thermal conductivity, e.g., a metal such as aluminum. In some embodiments, the heat exchanger 206 may be an extension of the mold body 210, i.e., the mold body 210 and the heat exchanger 206 may be formed of a seamless one-piece unitary construction.

In some exemplary embodiments, the heat exchanger 206 may be in fluid communication with the freezer chamber 124, while the ice making chamber 202 may not be in fluid communication with the freezer chamber 124. In other words, the ice making chamber 202 may be isolated from the freezer chamber 124 such that cold air from the freezer chamber 124 does not flow into the ice making chamber 202. Instead, in some exemplary embodiments, the cold air from the freezer chamber 124 may only flow around and through the heat exchanger 206, and in particular between fins 208 thereof. In some exemplary embodiments, e.g., as shown in FIG. 5, the heat exchanger 206 extends through the insulation 164 at the heat exchange opening 162. Therefore, in such exemplary embodiments, the heat exchanger 206 may be the only portion of the ice maker 200 not enclosed by the insulation 164. In such embodiments, the outlet 174 and inlet 176 are positioned on wall 123 such that the outlet 174 and inlet 176 correspond or align with the heat exchange opening 162 when the door 126 is in the closed position, such that cold air may flow from outlet 174, then downwardly along flow paths 209 (as described below) between fins 208 to inlet 176. More particularly, in such exemplary embodiments, the outlet 174 may be positioned such that when the door 126 is in the closed position, the outlet 174 is proximate to an upper portion of the heat exchanger 206 and is surrounded by the gasket 163, while the inlet 176 of return conduit 178 may be positioned below the outlet 174 of the supply conduit 172 such that when the door 126 is in the closed position the inlet 176 is proximate to a lower portion of the heat exchanger 206 and is surrounded by the gasket 163.

In various exemplary embodiments, the heat exchanger fins 208 may be oriented along the vertical direction V. In such embodiments, vertical air flow paths 209 may be defined between adjacent fins 208. In some exemplary embodiments, the vertical air flow paths 209 defined by the heat exchanger fins 208 are positioned within heat exchange opening 162 such that the air flow paths 209 extend between the outlet 174 of the supply conduit 172 and the inlet 176 of the return conduit 178 when the door 126 is in the closed position. In the exemplary embodiments illustrated herein, the fins 208 are continuous along the vertical extent of the heat exchanger 206 and are all parallel to one another. However, it is also possible within the scope of the present subject matter to provide fins 208 in various other configurations with vertical flow passages 209 therebetween. For example, individual fins 208 of the plurality of fins 208 may extend over less than the full vertical extent of the heat exchanger 206 and may be staggered with respect to one another. As another example, the fins 208 may be formed of separate rounded pieces, e.g., pins. Thus, it is to be understood that the fins 208 of the present subject matter are not limited to any particular shape and several possible variations thereof may be provided.

Figure 6:
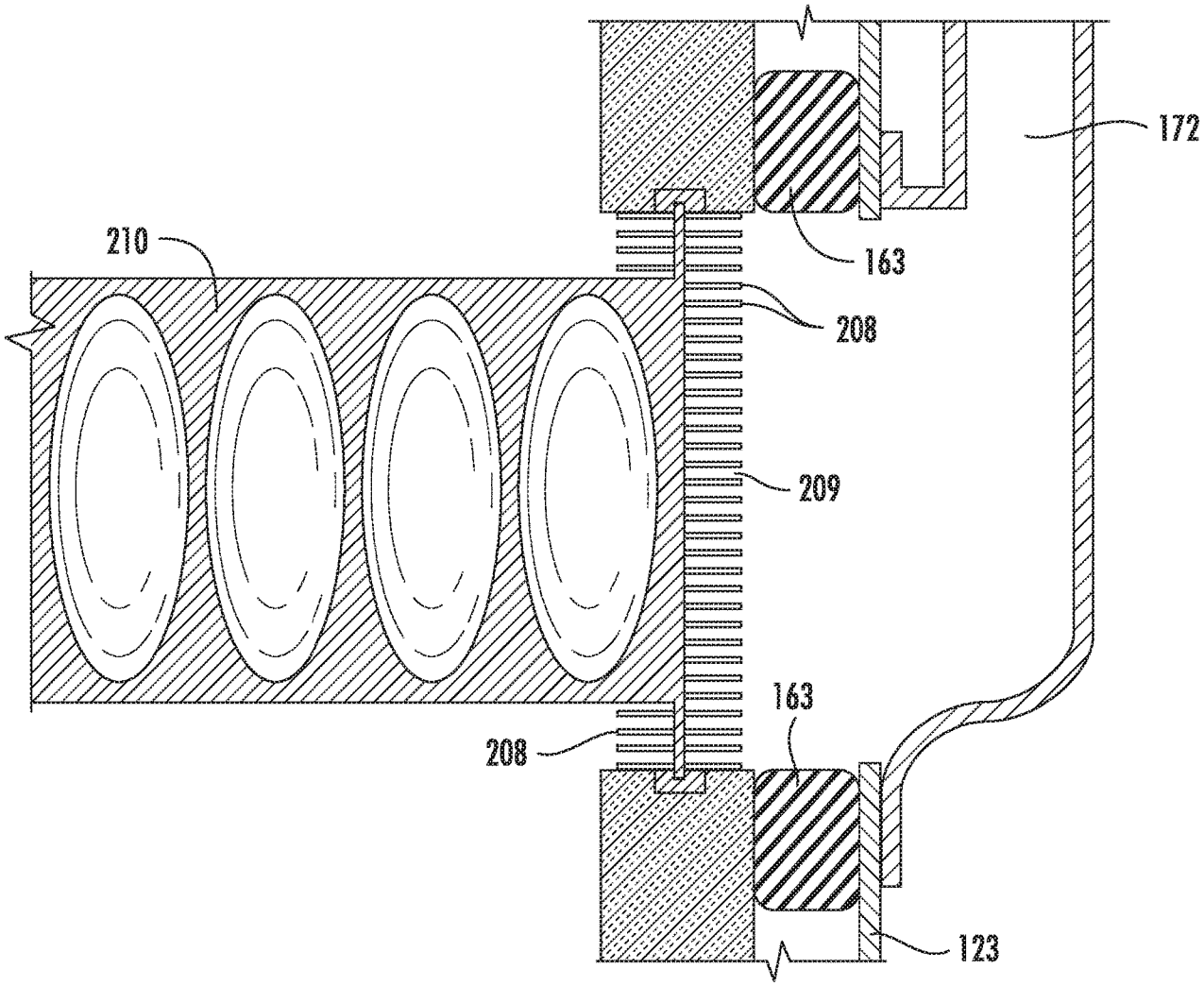
FIG. 6 provides a partial, section view of the ice making system taken along line 6-6 in FIG. 4.
Figure 7:
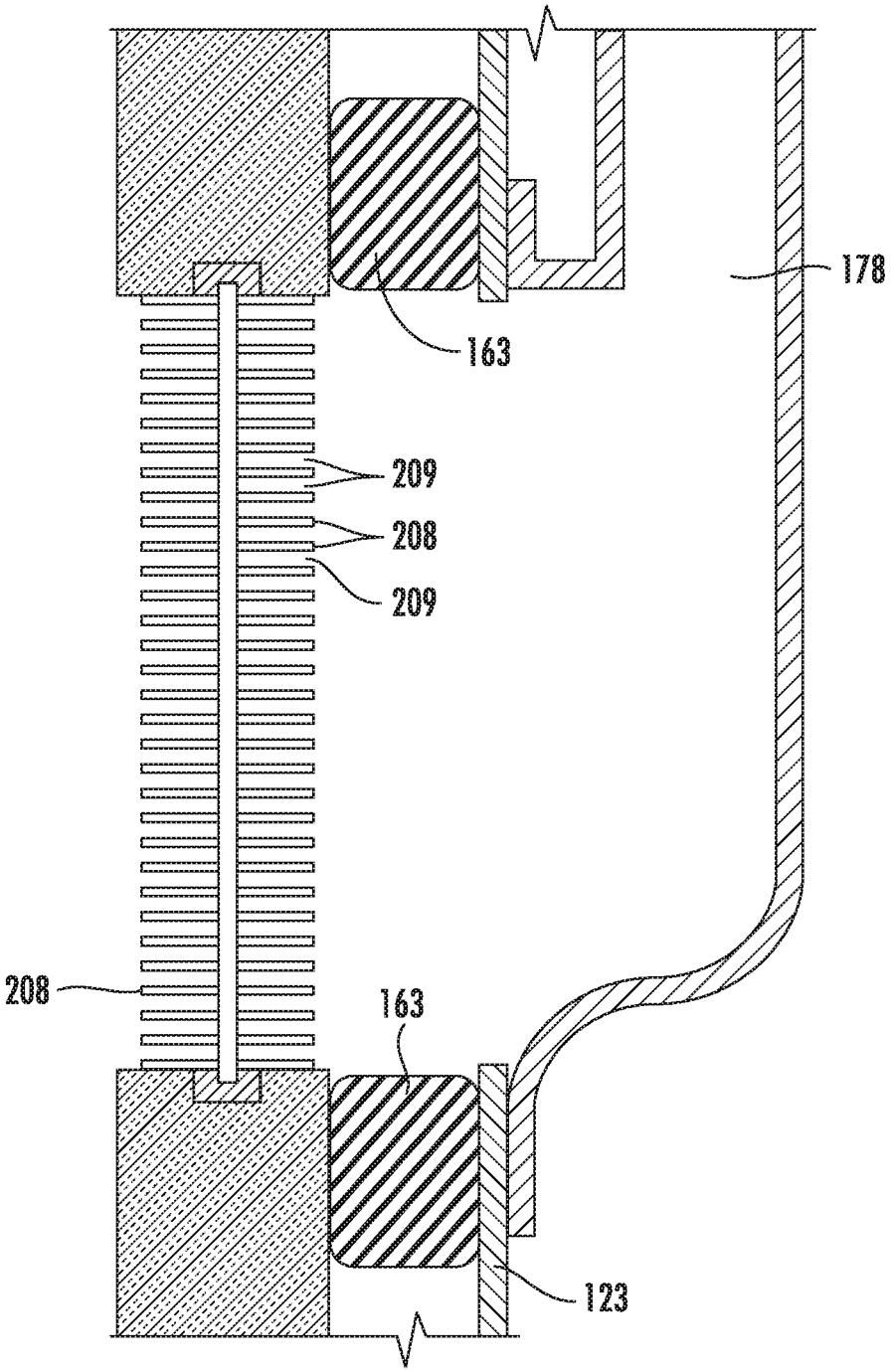
FIG. 7 provides a partial, section view of the ice making system taken along line 7-7 in FIG. 4.

As may be seen, e.g., in FIGS. 6 and 7, in some exemplary embodiments, when the door 126 is in the closed position, the heat exchanger 206 defines a width along the transverse direction T. The width of the heat exchanger 206 may be substantially equal to a corresponding dimension of the heat exchange opening 162. In some exemplary embodiments, the heat exchanger 206 may span the full extent of the heat exchange opening 162 across both a length and a width of the heat exchange opening 162. Also, in some exemplary embodiments, fins 208 may extend away from a central body of the heat exchanger 206, e.g., perpendicularly as illustrated for example in FIGS. 6 and 7. In other exemplary embodiments, fins 208 may be oblique to the central body. Fins 208 provide increased surface area for heat exchanger 206, e.g., as compared to a flat surface of the central body without fins 208, which may advantageously provide more rapid thermal energy transfer between chilled air from supply conduit 172 and heat exchanger 206.

In some embodiments, a fan 212 may be provided in the ice making chamber. The fan 212 is operable to provide air circulation within the ice making chamber 202 and in particular over the mold body 210. Such air circulation may be advantageous to assist in chilling the ice making chamber 202 and keeping the ice frozen. In particular, the ice making system 200 may be configured to operate fan 212 when the ice storage bin 204 is full and ice making is not required. In such embodiments, cold air may not be provided to the heat exchanger 206 from evaporator 170 when ice making is not required and therefore fan 212 may be activated when the storage bin 204 is full.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food chamber and a freezer chamber, the freezer chamber positioned below the fresh food chamber along a vertical direction, the cabinet also defining an icebox compartment outside of the freezer chamber and proximate to the fresh food chamber, the cabinet further defining a heat exchange opening at the icebox compartment; and an ice maker disposed within the icebox compartment, the ice maker comprising a mold body positioned in an ice making chamber, the mold body configured for receiving liquid water and forming ice in the mold body and a heat exchanger, the mold body and the heat exchanger formed of a one-piece seamless unitary construction, the heat exchanger positioned at the heat exchange opening and comprising a plurality of fins oriented along the vertical direction with vertical air flow paths defined between adjacent fins of the plurality of fins;

wherein the heat exchanger is in fluid communication with the freezer chamber and the ice making chamber is not in fluid communication with the freezer chamber such that cold air from the freezer chamber flows around and through the heat exchanger and does not flow into the ice making chamber.

2. The refrigerator appliance of claim 1, wherein the heat exchanger does not include liquid refrigerant.

3. The refrigerator appliance of claim 1, wherein the heat exchanger spans a full extent of the heat exchange opening across both a length and a width of the heat exchange opening.

4. The refrigerator appliance of claim 1, wherein the ice maker comprises a fan in the icebox compartment.

5. The refrigerator appliance of claim 1, wherein the cabinet comprises a door rotatably hinged at the fresh food chamber, the door comprising an inner surface, wherein icebox compartment is positioned at the inner surface of the door.

6. The refrigerator appliance of claim 5, wherein the icebox compartment further comprises a gasket extending around the heat exchange opening.

7. The refrigerator appliance of claim 6, wherein the gasket and heat exchange opening of the icebox compartment are disposed proximate to an inner surface of the door such that the gasket sealingly engages a wall of the fresh food chamber when the door is in a closed position.

8. The refrigerator appliance of claim 1, wherein the heat exchanger is in fluid communication with the freezer chamber via a circulation system providing convective thermal communication between a freezer evaporator positioned proximate the freezer chamber and the plurality of fins.

9. The refrigerator appliance of claim 8, wherein the circulation system comprises a supply duct, a return duct, and a fan, the fan connected to one of the supply duct or the return duct.

10. The refrigerator appliance of claim 9, wherein the supply duct comprises an outlet positioned at the wall of the fresh food chamber, the outlet positioned such that when the door is in the closed position, the outlet is proximate to an upper portion of the heat exchanger and is surrounded by the gasket.

11. The refrigerator appliance of claim 10, wherein the return duct comprises an inlet defined in the wall of the fresh food chamber, the inlet positioned below the outlet of the supply conduit such that when the door is in the closed position the inlet is proximate to a lower portion of the heat exchanger and is surrounded by the gasket.

12. The refrigerator appliance of claim 11, wherein the vertical air flow paths defined by the heat exchanger fins extend between the outlet of the supply duct and the inlet of the return duct when the door is in the closed position.

13. The refrigerator appliance of claim 1, further comprising an ice storage bin disposed within the icebox compartment below the mold body.

14. The refrigerator appliance of claim 1, wherein the icebox compartment includes insulation that insulates the ice maker from the fresh food chamber and the freezer chamber except at the heat exchange opening, the heat exchanger extending through the insulation at the heat exchange opening such that the heat exchanger is the only portion of the ice maker not enclosed by the insulation.

* * * * *